United States Patent [19]

Hauenstein

[11] 4,158,155

[45] Jun. 12, 1979

[54] IGNITION CIRCUIT FOR EXTINGUISHING TUBES IN ELECTRONIC FLASH EQUIPMENT

[75] Inventor: Alfred Hauenstein, Munich, Fed. Rep. of Germany

[73] Assignee: Siemens Aktiengesellschaft, Berlin & Munich, Fed. Rep. of Germany

[21] Appl. No.: 802,368

[22] Filed: Jun. 2, 1977

[30] Foreign Application Priority Data

Jun. 9, 1976 [DE] Fed. Rep. of Germany ..... 2625845

[51] Int. Cl.[2] ..... H05B 41/32

[52] U.S. Cl. ..... 315/151; 315/159; 315/200 R; 315/241 P

[58] Field of Search ..... 315/151, 159, 241 P, 315/241 R, 200 R; 354/145

[56] References Cited

U.S. PATENT DOCUMENTS 3,524,102 8/1970 Michalski et al. ..... 315/241 R X
3,857,064 12/1974 Vital et al. ..... 315/241 P
4,037,136 7/1977 Hoene ..... 315/241 P

FOREIGN PATENT DOCUMENTS 1965937 1/1972 Fed. Rep. of Germany.
1638977 2/1972 Fed. Rep. of Germany.
2316724 10/1974 Fed. Rep. of Germany ..... 315/241 P

*Primary Examiner*—Eugene R. LaRoche
*Attorney, Agent, or Firm*—Hill, Van Santen, Steadman, Chiara & Simpson

[57] ABSTRACT

An ignition circuit is provided for extinguishing tubes in electronic flash equipment for photography. The second winding of an ignition transformer is arranged in series to the extinguishing tube. A diode is connected in parallel to the secondary winding of the ignition transformer through which the extinguishing tube current flows after ignition. The extinguishing tube does not require an ignition electrode. The ignition circuit is advantageously employed in electronic flash equipment for photography having an automatic circuitry for control of flash luminance time.

4 Claims, 6 Drawing Figures

IGNITION CIRCUIT FOR EXTINGUISHING TUBES IN ELECTRONIC FLASH EQUIPMENT

BACKGROUND OF THE INVENTION

1. Field of the Invention

The invention relates to an ignition circuit for extinguishing tubes in electronic flash equipment for photography, having an automatic dosage detecting system for determining the quantity of light, wherein an extinguishing tube is employed in order to discharge a flash capacitor, or for extinguishing a series thyristor.

2. Description of the Prior Art

Electronic flash equipment for photography, having automatic light dosage or systems for controlling luminescence time, respectively, has been known in the trade for many years. The simplest method to control the luminous time of a flash tube is to parallel-connect an additional, dimmed flash tube — a so-called extinguishing tube — to the flash tube. This extinguishing tube is ignited as soon as the light reflected by the object being flashed has attained a pre-determined value. At this moment the extinguishing tube forms a low-ohmic parallel circuit path to the flash tube. The flash tube is extinguished, and the residual charge still present in the flash capacitoris destroyed in the extinguishing tube (See U.S. Pat. No. 3,857,064).

The fact that in the above-described circuit the residual charge still stored in the flash capacitor is unnecessarily destroyed has resulted in an additional circuit in which a controllable semi-conductor element, a thyristor preferably, is arranged in series to the flash tube. The thyristor is turned on together with the flash tube at the beginning of the flash process, and is turned off with the aid of an extinguishing circuit when the luminous time desired is attained. In this circuit modification in which the current through the flash tube is cut off means of the thyristor connected in series to the flash tube, which for this reason is also called a series thyristor, the residual charge still present in the flash capacitor remains intact. The extinguishing circuit consists of a capacitor, a choke, and an additional controllable circuit element. The capacitor is charged to a specific voltage at the beginning of the flash process. After attaining the predetermined value of the luminous time, the second circuit element is switched on. The capacitor discharges via the choke, the second circuit element, and the series thyristor. Therefore, the extinguishing current is in opposition to the flash current. As soon as the extinguishing current has risen to the value of the flash current, current through the series thyristor falls below the holding current; the series thyristor switches off, as desired, whereby the flash tube is also extinguished (See U.S. Pat. No. Re. 28,025).

As a controllable circuit element in order to switch on the extinguishing circuit, a thyristor, previously called an extinguishing thyristor, can also be utilized. However, it is also possible to use an extinguishing tube therefor. For this reason one can find gas-filled extinguishing tubes not only in conventional flash equipment which destroys the residual charge in the flash capacitor, but also in flash equipment retaining the residual charge in the flash capacitor.

Not only the flash tubes, but also the extinguishing tubes of the conventional flash equipment have an ignition electrode in order to ignite their gas-path. This ignition electrode, in the simplest case, consists of a metal ring mounted close to the cathode on the exterior of the wall of the tube. The secondary winding of the ignition transformer is connected with the cathode and the ignition electrode. This ignition transformer produces a high voltage impulse, such that the gas-filled tube is pre-ionized, and the discharge process between the main electrodes is thereby initiated. (See German Auslegeschrift No. 1,965,937, equivalent to U.S. Pat. No. 3,992,643).

SUMMARY OF THE INVENTION

It is an object of the present invention to provide an ignition circuit in which extinguishing tubes can be used without an ignition electrode.

This object is achieved in that the parallel circuit of a secondary winding of an ignition transformer and a diode lies in series to the extinguishing tube, and that a series circuit consisting of a capacitor and a controllable circuit element is arranged in the primary winding of the ignition transformer.

With the system of this invention the extinguishing tubes required for the circuits can be produced cheaper and simpler, and can be built into the flash apparatus since an exposed ignition electrode carrying a high voltage is no longer provided. Also, the ignition transformer has to produce only the difference between the breakdown voltage of the extinguishing tube and the voltage to which, depending on the circuit embodiment, the flash capacitor or the extinguishing capacitor is charged, and that now a second, simple, and inexpensive possibility is provided in order to ignite extinguishing tubes in electronic flash equipment.

In the present circuit use is made of the known technique of igniting gas-filled tubes by increasing the voltage on the electrodes via the ionization voltage. This is known, for example, from the German Offenlegungschrift No. 1,638,977, equivalent to U.S. Pat. No. 3,355,625. In this known circuit the ignition voltage is provided from the secondary winding of the ignition transformer to the electrodes of the flash tube via a capacitor. A diode is arranged between a flash tube and a flash capacitor, said diode decoupling the flash capacitor from the high ignition voltage. The capacitor arranged in series with the ignition transformer serves the purpose of decoupling the secondary winding of the transformer from the flash capacitor. The known circuit additionally requires a high voltage rating capacitor with respect to the circuit of this invention. Moreover, the ignition transformer has to provide the complete ignition voltage, whereas in the circuit of this invention the voltage existing in the flash or extinguishing capacitor is also utilized for igniting the tube since the voltage produced in the ignition transformer is in series with the capacitor voltage. It is known that high voltage transformers make particularly high demands on insulation so that the ignition transformer employed in the inventive circuit is preferable due to the relatively low secondary voltage.

DESCRIPTION OF THE PREFERRED EMBODIMENTS

Figure 1:
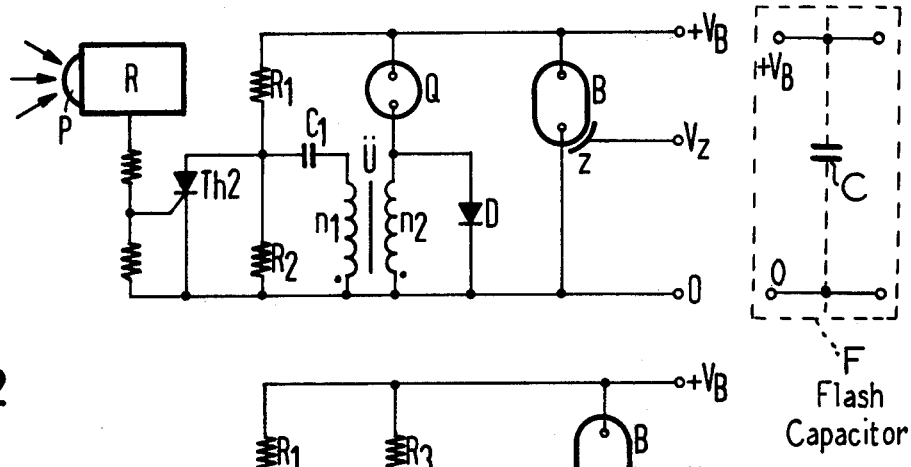
FIG. 1 is a schematic diagram illustrating portions of the circuit of an electronic automatic flash apparatus containing the ignition circuit of this invention.

FIG. 1 illustrates portions of the circuit of an electronic automatic flash apparatus required for the explanation of the invention, in which the residual charge stored in a flash capacitor C in a flash capacitor F is destroyed. One recognizes a flash tube B is illustrated having an ignition electrode Z whose main electrodes are connected to the flash voltage $+V_B$ or to ground. The extinguishing tube Q lies parallel to the flash tube B wherein the secondary winding $n_2$ of the ignition transformer U having a parallel connected diode D is connected in series with the extinguishing tube Q. The series circuit consisting of a capacitor $C_1$ and a thyristor $Th_2$ is connected to the primary winding $n_1$ of the ignition transformer U. The two resistors $R_1$ and $R_2$ serve the purpose of charging the capacitor $C_1$ to a defined voltage.

Furthermore, a photo element P is illustrated for receiving the light reflected by the flashed object and passes a corresponding current onto the control circuit R. The control circuit R similar to prior art control circuits provides the control electrode of the thyristor $Th_2$ with an impulse, whereupon the thyristor switches to its low-ohmic condition. Therefore the capacitor $C_1$ discharges via the primary winding $n_1$ of the ignition transformer U, whereby a voltage is produced in the secondary winding $n_2$ which is negative at the winding end connected with the quenching tube U, and is positive at the winding end connected to ground and referenced with a dot. This secondary voltage adds to the flash voltage $V_B$ in such a fashion that the break-down voltage on the extinguishing tube Q is exceeded. As soon as the extinguishing tube Q is ignited, the residual charge stored in the flash capacitor flows to ground from the connection $+V_B$ via the diode D connected in a flow-direction, whereby the flash tube B is extinguished as desired.

Figure 2:
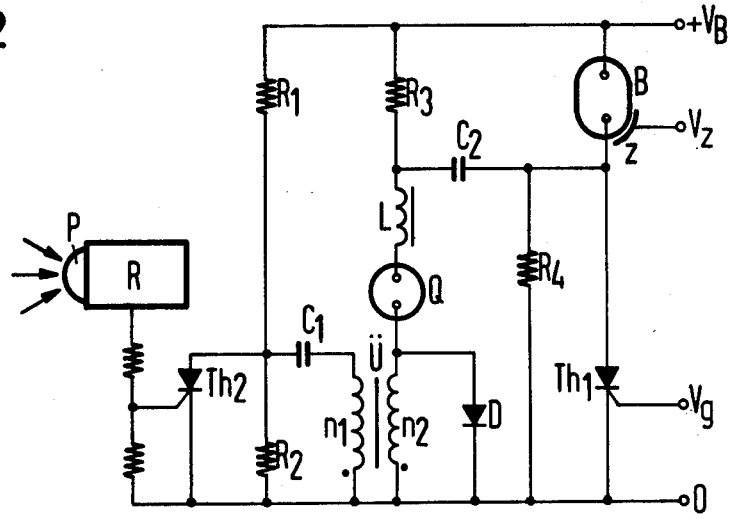
FIG. 2 is a schematic diagram of the ignition circuit of this invention which extinguishes the flash tube by controlling a series thyristor connected to the flash tube.

FIG. 2 illustrates a circuit section for a flash apparatus, in which the current flow is connected through the flash tube B with the aid of a series thyristor $Th_1$. The voltages $V_z$ and $V_g$ are simultaneously produced at the beginning of the flash process by the flash circuit F in well known manner, whereby the flash tube B is ignited and the series thyristor $Th_1$ is switched on. The extinguishing capacitor $C_2$ is charged to the flash voltage $V_B$ via the resistors $R_3$ and $R_4$. As soon as the light received by the photo receiver P has attained the set light intensity, the control circuit R gives off an impulse to the thyristor $Th_2$, switching it into its low-ohmic condition. The capacitor $C_1$ charged via the two resistors $R_1$ and $R_2$ is then discharged via the primary winding $n_1$ of the ignition transformer U. A voltage is then produced in the secondary winding $n_2$ of the ignition transformer U which adds to the voltage present in the capacitor $C_2$ and ignites the extinguishing tube Q. The capacitor $C_2$ discharges via the coil L, the quenching tube Q, the diode D, and the series thyristor $Th_1$. The direction of the extinguishing current is in opposition to the direction of the flash current. As soon as the extinguishing current has attained the value of the flash current, the resulting current of the series thyristor $Th_2$ falls below threshold; the series thyristor switches into its high-ohmic condition; and the flash tube B is extinguished.

The coil L connected in series with the extinguishing tube Q serves the purpose of limiting the rise of the extinguishing current to a value not endangering the components situated in the extinguishing circuit. In addition, the coil L forms a series oscillating circuit with the quenching capacitor $C_2$ whereby the extinguishing process with suitable parameter choices is favorably influenced as is well known.

Figure 3:
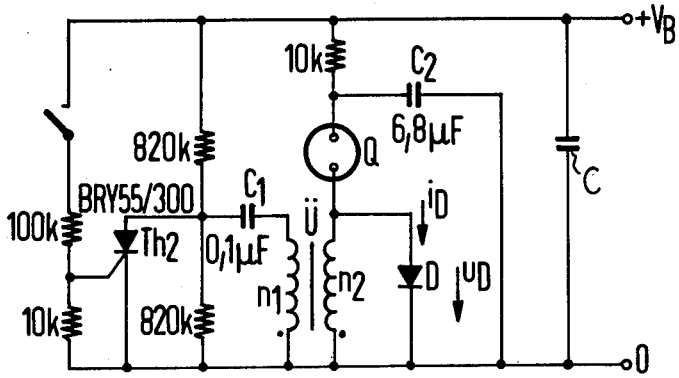
FIG. 3 is a schematic diagram of a simplified circuit of the system shown in FIG. 2.
Figure 4:
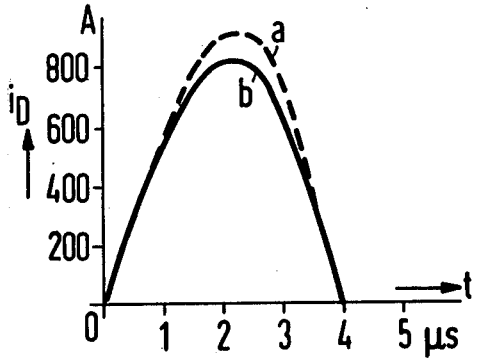
FIGS. 4, 5 and 6 illustrate current, voltage and power relationships with respect to time for the diode of FIG. 3.
Figure 5:
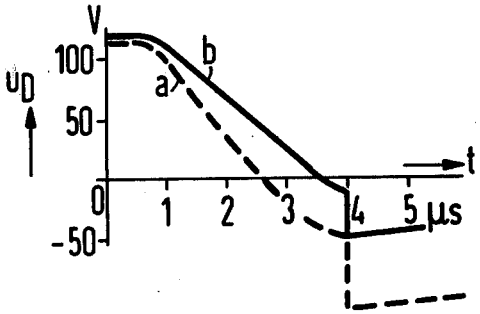
Figure 6:
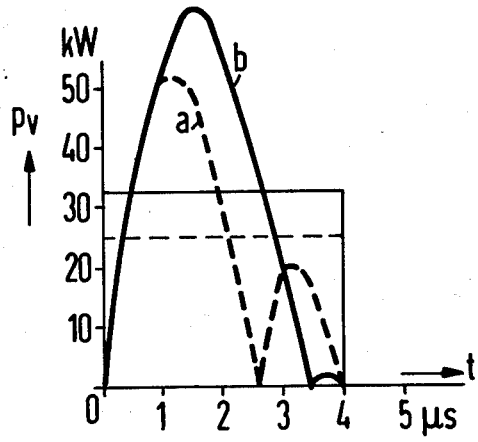

FIG. 3 illustrates a circuit which is a slight simplification of FIG. 2 and to which the measuring curves illustrated in FIGS. 4, 5 and 6 refer. One perceives that in comparison with the circuit illustrated in FIG. 2, the coil L, the series thyristor $Th_1$, and the flash tube B are missing. Also, the control circuit R is replaced by the switch S. Current $i_D$ is indicated through the diode D, as well as the voltage $u_D$ indicated across the diode D during the extinguishing process.

FIG. 4 illustrates the variation of the diode current $i_D$ in dependence upon time t. The curve (a) illustrates the variation of the current when utilizing a fast diode (BY 295); the curve (b) illustrates the current variation when utilizing a medium fast diode (1 N 4007). One recognizes that the current $i_D$ reaches its maximum value of 800 to 900 Amperes after about 2 $\mu$-seconds and returns to 0 after 4 $\mu$-seconds.

FIG. 5 illustrates the voltage $u_D$ across the diode in dependence upon time t for the two diodes being compared above.

FIG. 6 illustrates the output power loss $p_V$ in the diode. One recognizes that the peak power output reaches a value of 50 to 80 kilowatts after nearly 2 $\mu$-seconds. However, since the current flow returns again to zero after 4 $\mu$-seconds, the average output power loss is so small that diodes designed for a flow current of about one ampere can readily be used. The reverse voltage of the diode has to be sufficiently high so that the diode will not be destroyed by the voltage produced in the secondary winding of the ignition transformer U.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An ignition circuit for extinguishing tubes in electronic flash apparatus, comprising:
   - an automatic control means for detecting the luminance duration of the flash apparatus;
   - an extinguishing tube means used for discharging a flash capacitor of the flash apparatus;
   - an ignition transformer having primary and secondary windings;
   - a parallel circuit formed of the secondary winding and a diode, said parallel circuit being connected in series with said extinguishing tube means; and
   - a series circuit comprising a capacitor and controllable circuit element being arranged in the primary winding, said controllable circuit element being controlled by said automatic control means.

2. The ignition circuit of claim 1 in which said controllable circuit element comprises a thyristor.

3. An ignition circuit for extinguishing tubes in an electronic flash apparatus, comprising:
   - an automatic control means for detecting the luminance duration of the flash apparatus;

an extinguishing tube means used for turning off a series thyristor connecting with a flash tube in the flash apparatus;

an ignition transformer having primary and secondary windings;

a parallel circuit formed of the secondary winding and a diode, said parallel circuit being connected in series with said extinguishing tube means; and a series circuit comprising a capacitor and controllable circuit element being arranged in the primary winding, said controllable circuit element being controlled by said automatic control means.

4. An automatic electronic flash system for extinguishing a flash unit after a detected luminance time, comprising:

a flash unit having a flash voltage producing means; luminance time control means for sensing the duration of a flash from the flash unit;

an ignition transformer having primary and secondary windings;

a series circuit of a capacitor and a switching means connected across the primary winding, said switching means being activated by an output from said luminance time control means;

an extinguishing member;

a diode across said secondary winding to form a parallel circuit in series with said extinguishing member; and said parallel circuit and extinguishing member being connected to the flash voltage producing means.

* * * * *